US010677009B2

(12) United States Patent
Costa de Oliveira et al.

(10) Patent No.: US 10,677,009 B2
(45) Date of Patent: Jun. 9, 2020

(54) SMART DRILLING JAR

(71) Applicant: Saudi Arabian Oil Company, Dhahran (SA)

(72) Inventors: Victor Carlos Costa de Oliveira, Dhahran (SA); Mario Augusto Rivas Martinez, Dhahran (SA); Khaled K. Abouelnaaj, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 186 days.

(21) Appl. No.: 15/890,449

(22) Filed: Feb. 7, 2018

(65) Prior Publication Data

US 2019/0242207 A1 Aug. 8, 2019

(51) Int. Cl.

| | |
|---|---|
| ***E21B 31/113*** | (2006.01) |
| ***E21B 47/00*** | (2012.01) |
| ***E21B 31/107*** | (2006.01) |

(52) U.S. Cl.

CPC ..... *E21B 31/1135* (2013.01); *E21B 31/107* (2013.01); *E21B 31/113* (2013.01); *E21B 47/00* (2013.01)

(58) Field of Classification Search

CPC .... E21B 31/107; E21B 31/113; E21B 31/135; E21B 4/14

See application file for complete search history.

(56) References Cited

U.S. PATENT DOCUMENTS

| | | | | |
|---|---|---|---|---|
| 2,978,030 A * | 4/1961 | Green | E21B 31/113 166/98 |
| 3,180,433 A | 4/1965 | Mason | |
| 5,931,242 A * | 8/1999 | Oettli | E21B 31/113 166/178 |
| 6,176,325 B1 * | 1/2001 | Rodger | E21B 7/24 175/293 |
| 8,171,988 B2 | 5/2012 | Hallundbaek et al. | |
| 8,499,836 B2 * | 8/2013 | Moriarty | E21B 31/107 166/178 |

(Continued)

OTHER PUBLICATIONS

International Search Report and Written Opinion for International Application No. PCT/US2019/016980 dated Jun. 12, 2019; pp. 1-18.

(Continued)

*Primary Examiner* — Jennifer H Gay
(74) *Attorney, Agent, or Firm* — Bracewell LLP; Constance G. Rhebergen; Vivek P. Shankam

(57) ABSTRACT

A drilling jar in an oil and gas drilling operation or fishing operation includes a control unit having one or more transceivers configured to communicate wirelessly with a surface control unit. The control unit is configured to receive an activation signal from the surface control unit, and cause to activate the drilling jar in response to the activation signal. The wireless transceivers may communicate using any wireless communication technology, including but not limited to Wi-Fi, Wi-Fi Direct, and BLE. A method for operating a drilling jar includes receiving, by a control unit comprising one or more transceivers configured to communicate wirelessly with a surface control unit, an activation signal from the surface control unit, and causing to activate the drilling jar in response to the activation signal.

15 Claims, 3 Drawing Sheets

(56) References Cited

U.S. PATENT DOCUMENTS

| | | | | |
|---|---|---|---|---|
| 8,789,598 | B1 * | 7/2014 | Mlcak | E21B 31/107 166/178 |
| 8,931,569 | B2 | 1/2015 | Fagley, IV et al. | |
| 9,631,446 | B2 * | 4/2017 | Hradecky | E21B 31/107 |
| 9,822,598 | B2 * | 11/2017 | Miller | E21B 31/107 |
| 9,951,602 | B2 * | 4/2018 | Hradecky | E21B 47/01 |
| 9,988,869 | B2 * | 6/2018 | Kartha | E21B 31/107 |
| 2003/0070842 | A1 | 4/2003 | Bailey et al. | |
| 2004/0045351 | A1 * | 3/2004 | Skinner | E21B 47/0006 73/152.48 |
| 2009/0095490 | A1 * | 4/2009 | Moriarty | E21B 31/107 166/383 |
| 2009/0266544 | A1 * | 10/2009 | Redlinger | E21B 4/02 166/298 |
| 2011/0297380 | A1 * | 12/2011 | Alberty | E21B 31/113 166/301 |
| 2015/0176357 | A1 * | 6/2015 | Hradecky | E21B 31/107 166/250.01 |
| 2016/0102514 | A1 * | 4/2016 | Miller | E21B 31/107 166/301 |
| 2016/0258270 | A1 * | 9/2016 | Hradecky | E21B 47/01 |
| 2016/0356111 | A1 * | 12/2016 | Castillo | E21B 31/107 |
| 2017/0030159 | A1 | 2/2017 | Vick, Jr. | |
| 2017/0067306 | A1 | 3/2017 | Strachan | |
| 2017/0175475 | A1 * | 6/2017 | Kartha | E21B 31/107 |
| 2019/0242207 | A1 * | 8/2019 | Costa de Oliveira | E21B 31/107 |

OTHER PUBLICATIONS

Invitation to pay additional fees and, where applicable, protest fee dated Apr. 16, 2019 for International Application No. PCT/US2019/016980; pp. 1-15.

* cited by examiner

SMART DRILLING JAR

BACKGROUND

Field

Embodiments of the present disclosure generally relate to drilling jars for use in oil and gas wells, and more specifically to a smart drilling jar.

Description of Related Art

BACKGROUND

A drilling jar is a tool added to the bottom hole assembly (BHA) with an objective to provide powerful downward and/or upward impact during a stuck pipe incident. Its main application is to free a stuck pipe in a well. The need to maximize the efficiency of drilling jars drives the oil and gas industry to develop and improve drilling jar mechanisms in order to be able to deliver an efficient system and jarring up and/or down for a longer period of time. However, doubts about the tool's integrity as well as the performance and efficiency of the drilling jar remain. There are mainly three types of drilling jars: mechanical, hydraulic and hydro-mechanical drilling jars.

A mechanical drilling jar has a mechanism that is set to release at a specific preset load. To fire the drilling jar, a load (pull or push load) must be applied. If the load is not applied, the drilling jar may not fire. The drilling jar fires immediately once this predetermined load is reached. A mechanical drilling jar uses a mechanical latch mechanism, which is set to be released at a predetermined force, which is preset before running the drilling jar in the hole.

The mechanical drilling jar remains locked in position until a force exceeding the latch presetting load is applied to the drilling jar. This prevents the drilling jar from firing under normal drilling, tripping or handling operations. The mechanical drilling jar can be operated in either tension or in compression. However, there are two disadvantages with a mechanical drilling jar. The first disadvantage is that when the over pull/slack-off load exceeds the latch setting load, the drilling jar fires immediately. This increase in load could be intentional or unintentional. The resulting shock wave transmitted to the surface can damage the drilling rig hoisting equipment. The second disadvantage is that the drilling jar may fire immediately as there is no time delay. The two types of mechanical drilling jars are 1) with preset load latch setting, and 2) with a latch load adjustable downhole.

A hydraulic drilling jar overcomes the disadvantages of mechanical drilling jars. Its release mechanism is hydraulic. After the over pull is applied, there is a time delay, for example of about 30 to 180 seconds, before the drilling jar actually fires and delivers a blow. Tensile load applied to a hydraulic drilling jar creates internal pressure in the drilling jar. This pressure forces the hydraulic oil to move from one section to another (named chamber) in a controlled manner. This flow causes the delay in functioning of the drilling jar. The delay period is approximately 30 seconds to 3 minutes before the drilling jar is released. The firing load is variable by the amount of over pull or slack off on the drilling jar. The higher the over pull or slack off, the shorter may be the delay period.

Hydraulic drilling jars, however, do not have an internal latch, therefore they can easily transition from tension to compression. For this reason a safety clamp is required on the mandrel to hold the drilling jar in the open position, while racked back on derrick, before running in the hole. The safety clamp must support the weight of at least two drill collars above the drilling jar. Some advantages of hydraulic drilling jars include the time delay allows the driller to adjust the amount of over pull applied, and by doing this, the intensity of the jarring impact can be controlled. The time delay allows the driller to engage the drum brake before the drilling jar fires. This prevents the resulting shock wave from damaging the drilling rig hoisting equipment. Additionally, the minimum load to fire the drilling jar is just above the internal drag in the jar. Any load above the internal drag may cause the jar to fire contrary to a mechanical drilling jar, which requires exceeding the preset load. Normally, hydraulic drilling jars have a hydraulic mechanism to fire up, but a mechanical mechanism to fire down. Double Acting Hydraulic drilling jars (DAHDJ) are also available. These drilling jars have hydraulic firing mechanisms, in both the up and the down directions. Hydraulic drilling jars, however, have some limitations and restrictive operating procedures.

For example, the drilling jar must be kept in an extended (open) or compressed (closed) position at all times to prevent unexpected firing during normal drilling operations. Additionally, when running in the hole with the drilling jar extended, special care must be taken to avoid closing or "cocking" the drilling jar when passing through tight spots, ledges, or doglegs. Cocking is the term used to bring the drilling jar back in to working (jarring) position to fire again (up or down). If there is a possibility that the drilling jar may have closed, the string must be held in the elevators until the drilling jar fires into the open position. If the drilling jar fires while the drill string is supported in the slips, the resulting shock wave can cause the slips to jump out of the rotary table, releasing the drill string. If DAHDJ are run in compression (closed position), these may "cock" when picked up off bottom. It means that the drilling jar must be fired down lightly (the drilling jar allowed to bleed down) when the drilling bit tags bottom to minimize the down-jarring impact on the bit.

Additionally, when lifting off-bottom with the drilling jar in compression (closed position), the drill string must be picked up and held in the elevators, until the drilling jar has fired into the open position. Additionally, when back reaming during a tight hole situation, the wall drag can often support the BHA below the drilling jar. When the drill string is lowered to set the slips, the drilling jar may close to the set position. Picking up on the drill string again, may then cause the drilling jar to fire unexpectedly. When handling the drilling jar on the rig floor, a safety clamp must be installed to keep the drilling jar from closing into the "cocked" position. The safety clamp must not be removed until the drilling jar is in tension in the drill string. There is, however, a risk of the safety clamp being overlooked when running in the hole, preventing the drilling jar from functioning downhole.

The third type of drilling jar, which is most commonly used during drilling operations, is the hydro-mechanical drilling jar. It combines the hydraulic and mechanical releasing mechanisms. The hydro-mechanical drilling jar has the features of both hydraulic and mechanical drilling jars without the disadvantages of either type. This tool provides several distinct advantages over conventional hydraulic or mechanical drilling jars. For example, hydraulic time delay allows the driller to vary the over pull applied, and then apply the draw works drum brake. By doing this, the jarring force is controlled and damage to the drilling rig hoisting equipment is prevented. Location in BHA is less restricted.

The jar can be used in tension or compression within the limits of the latch setting. No safety clamps or special handling procedures are required on the rig floor. The drilling jar may not fire unexpectedly when drilling, or tripping in or out of the hole. The latch mechanism prevents drilling jar movement during normal drilling operations, eliminating unnecessary wear of internal components. The latch resets automatically, locking the drilling jar in the neutral position. The linear action latch is not affected by torque, and there is double acting, i.e. jarring action in both up and down directions.

SUMMARY

Example embodiments disclosed relate to an apparatus such as a smart drilling jar built with a smart hydraulic and mechanical system that can be used to provide an impact force when a stuck incident occurs, as well as, ending the limitation regarding drilling jar placement in the BHA. The disclosure addresses the need to improve the performance and effectiveness of using drilling jars in vertical, deviated, or horizontal wells. The smart drilling jar system can be activated remotely by drilling crew and a hydraulic force can be applied on top of compression springs. When the force exceeds the compression springs tolerance, this may move a mandrel down which may deliver a desired impact to the BHA, helping to free the BHA. Also, the system may be able to communicate with surface in real time wirelessly.

Accordingly, one example embodiment is a drilling jar including a control unit having one or more transceivers configured to communicate wirelessly with a surface control unit. The control unit is configured to receive an activation signal from the surface control unit, and cause to activate the drilling jar in response to the activation signal. The wireless transceivers may communicate over a wireless communication method selected from the group consisting of Wi-Fi, Wi-Fi Direct, Bluetooth, Bluetooth Low Energy, and ZigBee. The control unit may further include one or more processors, and a non-transitory computer readable medium connected to the one or more processors. The drilling jar may further include a hydraulic power unit including a sealed hydraulic oil reservoir configured to store hydraulic oil, an expandable chamber configured to receive the hydraulic oil from the hydraulic oil reservoir, and a hydraulic pump configured to move the hydraulic oil from the hydraulic oil reservoir to the expandable chamber when the drilling jar is activated. The drilling jar may further include a hammer connected to the hydraulic power unit, the hammer configured to generate an impact force when the drilling jar is activated. The drilling jar may also include a compression spring attached to the hammer, the compression spring configured to receive an impact force from the hammer, and transmit the impact force to the bottom of the drilling jar. The drilling jar may further include a battery unit configured to deliver power to the hydraulic power unit and the control unit. The drilling jar may also include a relief pump configured to move the hydraulic oil from the expandable chamber to the hydraulic oil reservoir when the drilling jar is deactivated. The drilling jar may further include impact and impulse force sensors that may be located at the top and bottom of the drilling jar, the impact and impulse force sensors configured to measure the impact force delivered by the hammer, and transmit the measured value to the control unit.

Another example embodiment is a method for operating a drilling jar. The method may include receiving, by a control unit comprising one or more transceivers configured to communicate wirelessly with a surface control unit, an activation signal from the surface control unit, and causing to activate the drilling jar in response to the activation signal. The method may also include storing hydraulic oil in a sealed hydraulic oil reservoir, and moving, by a hydraulic pump, the hydraulic oil from the hydraulic oil reservoir to an expandable chamber when the drilling jar is activated. The method may further include generating an impact force, by a hammer connected to the hydraulic pump, when the drilling jar is activated. The method may also include receiving, by a compression spring attached to the hammer, an impact force from the hammer, and transmitting the impact force to the bottom of the drilling jar. The method may further include providing a battery unit to deliver power to the hydraulic pump and the control unit. The method may also include moving, by a relief pump, the hydraulic oil from the expandable chamber to the hydraulic oil reservoir when the drilling jar is deactivated. The method may further include measuring, by impact and impulse force sensors located at the top and/or bottom of the drilling jar, the impact and impulse force delivered by the hammer, and transmitting the measured value to the control unit. The method may also include storing the measured value in a non-transitory computer readable medium in the control unit, and wirelessly transmitting, by the control unit, the measured value to the surface control unit. The wireless transceivers may communicate over a wireless communication method selected from the group consisting of Wi-Fi, Wi-Fi Direct, Bluetooth, Bluetooth Low Energy, and ZigBee.

Another example embodiment is a drilling jar including a hydraulic power unit having a sealed hydraulic oil reservoir configured to store hydraulic oil, an expandable chamber configured to receive the hydraulic oil from the hydraulic oil reservoir, and a hydraulic pump configured to move the hydraulic oil from the hydraulic oil reservoir to the expandable chamber when the drilling jar is activated. The drilling jar may also include a hammer connected to the hydraulic power unit, the hammer configured to generate an impact force when the drilling jar is activated, and a compression spring attached to the hammer, the compression spring configured to receive an impact force from the hammer, and transmit the impact and/or impulse force to the top and/or bottom of the drilling jar. The drilling jar may also include a control unit comprising one or more transceivers configured to communicate wirelessly with a surface control unit, wherein the control unit is configured to receive an activation signal from the surface control unit, and cause to activate the drilling jar in response to the activation signal. The drilling jar may further include a battery unit configured to deliver power to the hydraulic power unit and the control unit. The drilling jar may also include an impact and/or impulse force sensor located at the top and/or bottom of the drilling jar, the impact and/or impulse force sensors configured to measure the impact force delivered by the hammer, and transmit the measured value to the control unit. The wireless transceivers may communicate over a wireless communication method selected from the group consisting of Wi-Fi, Wi-Fi Direct, Bluetooth, Bluetooth Low Energy, and ZigBee.

BRIEF DESCRIPTION OF DRAWINGS

The foregoing aspects, features, and advantages of embodiments of the present disclosure may further be appreciated when considered with reference to the following description of embodiments and accompanying drawings. In describing embodiments of the disclosure illustrated in the appended drawings, specific terminology may be used for the sake of clarity. However, the disclosure is not intended to be limited to the specific terms used, and it is to be understood that each specific term includes equivalents that operate in a similar manner to accomplish a similar purpose.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

DETAILED DESCRIPTION

The methods and systems of the present disclosure may now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure may be thorough and complete, and may fully convey its scope to those skilled in the art.

Figure 1:
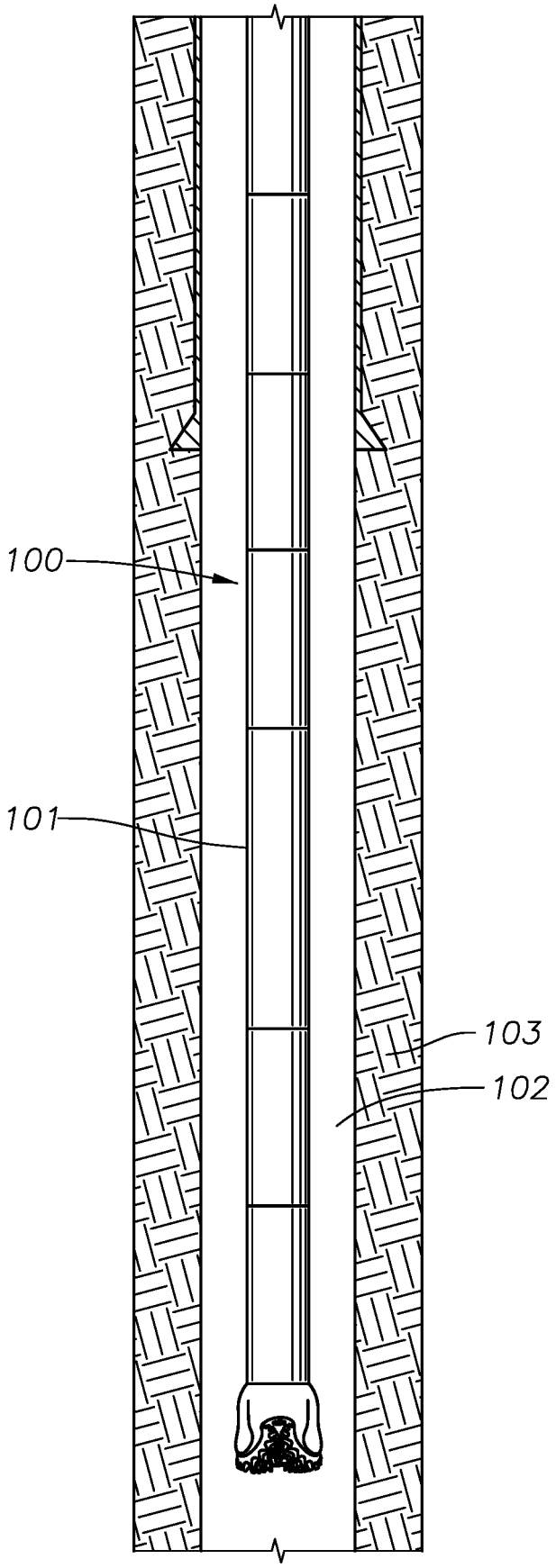
FIG. 1 is a schematic of a bottom hole assembly (BHA) including a drilling jar, according to one or more example embodiments.

Turning now to the figures, FIG. 1 is a schematic of a bottom hole assembly (BHA) 100 including a drilling jar 101, according to one or more example embodiments. The drilling jar 101 may be positioned anywhere in the BHA 101. Although only one drilling jar 101 is illustrated in this figure, multiple drilling jars 101 can be distributed along the design of the drilling string or BHA 100. Additionally, the drilling jar 101 can be modified and applied to any size of drilling string. Annular space between the BHA 101 and the subsurface formation 103 or the previous casing is indicated by reference numeral 102.

According to one example embodiment, drilling jar 101 is able to deliver a high impact and/or impulse force to the BHA, helping to free the BHA when stuck pipe incidents occur. The electronic system contained in the drilling jar 101, which may be discussed in further detail with reference to FIGS. 2 and 3, can be activated or deactivated multiple times remotely via a wireless transmission mechanism. This automation can allow to improve the efficiency and performance of drilling jars and may end the limitation regarding drilling jar placement in the BHA.

Figure 2:
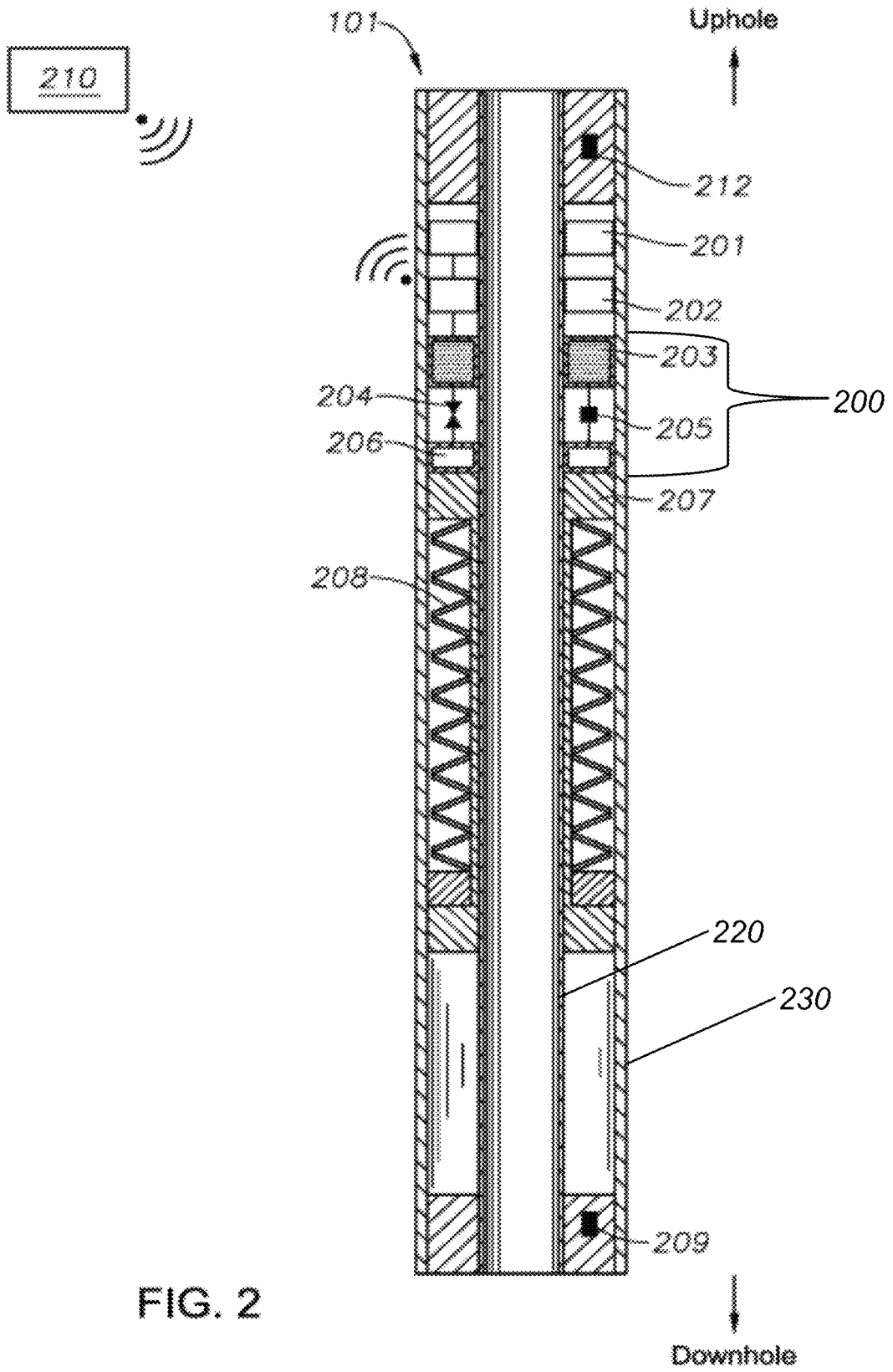
FIG. 2 is a schematic of a drilling jar in a deactivated state, according to one or more example embodiments.

FIG. 2 is a schematic of a drilling jar 101 in a deactivated state, according to one or more example embodiments. The drilling jar 101 may include a battery unit 201, which may deliver power to a control unit 202 and a hydraulic power unit 200. Battery unit 201 can be recycled and replaced at the end of its life. Control unit 202 is the interface between the drilling jar 101 and a surface control unit 210. One function of the control unit 202 is to organize the information from the sensors and submit to the surface control unit 210 via wireless or electromagnetic communication or wired communication. The control unit 202 may include one or more processors (not shown) that may be responsible to process the information from the sensors and submit to the information to the surface control unit 210. Additionally, the control unit 202 may be able to deliver a full diagnostic of the functionality of the drilling jar 101 in real time, identifying any failure that may have happened with the sensors. This may be possible due to continued communication (data transmission and reception) through the control unit 202.

Control unit 202 may further include a non-transitory computer readable medium of a suitable size. This medium may be used to record all information regarding the operation of the drilling jar 101. The information may be downloaded at the surface, using a wired connection, wireless connection, or a flash drive, when the drilling jar 101 is recovered. Functionalities such as hydraulic power unit performance and electronics performance can also be recorded and further analyzed. Control unit 202 may include one or more transceivers, such as transmitters and receivers, that may communicate between the casing, annulus and the surface. The wireless transceivers may communicate over a wireless communication method selected from the group consisting of Wi-Fi, Wi-Fi Direct, Bluetooth, Bluetooth Low Energy, and ZigBee. The communication between the control unit 202 and the battery 201, however, can be wired.

Drilling jar 101 may further include a sealed hydraulic oil reservoir 203 that it is connected to a hydraulic pump 204. The reservoir 203 may store the hydraulic oil that may be used to move to an expandable chamber 206. The reservoir 203 may be sealed to avoid contamination with mud. Drilling jar 101 may further include a hydraulic pump 204 for moving the hydraulic oil from the hydraulic oil reservoir 203 to the expandable chamber 206. The hydraulic pump 204 may deliver a pressure to the control unit 202. The control unit 202 organizes the information and transmits the organized information to the surface control unit 210. Drilling jar 101 may further include a relief pump 205 whose main objective is to move the hydraulic oil from the expandable chamber 206 back to the hydraulic oil reservoir 203. The relief pump 205 may be activated after the drilling jar has been activated or fired. The hydraulic oil may be pumped to the expandable chamber 206 and the expandable chamber 206 may compress the hammer 207. The hammer 207 may transmit the force to the compression springs 208. Hammer 207 is a solid metal piece that may be allocated between the compress rings 208 and expandable chamber 206. The hammer 207 is the moving part inside the drilling jar 101. It is also responsible to produce the downward and/or upward force (choke wave) after the drilling jar 101 is fired. Compression springs 208 may include bending metal springs. The springs 208 may receive a compression force from the hammer 207. When the compression springs 208 limits are exceeded, the springs 208 may change the shape, thereby becoming flat. The hammer 207 may move downward and/or upward and all the force may be transmitted to the bottom and/or top of the drilling jar 101, creating a shock wave that may help to free the stuck BHA. After the drilling jar 101 is activated and no pressure is applied above the hammer 207, the compression springs 208 may return back to their normal shape.

Drilling jar 101 may further include one or more impact and/or impulse force sensors 209, 212. The sensors 209, 212 may be located on the bottom and/or top of the drilling jar 101, close to the connection, and may measure the impact and/or impulse force delivered by the hammer 207. This measured value may be transmitted to the control unit 202. The control unit 202 may send this information to the surface control unit 210. In one example embodiment, the sensor may be wired connected to the control unit 202.

Drilling jar 101 has an inner diameter 220 and an outer diameter 230. The components of the drilling jar 101, including the hydraulic power unit 200, battery unit 201, control unit 202, reservoir 203, hydraulic pump 204, relief pump 205, expandable chamber 206, hammer 207, compression springs 208, and force sensors 209, 212, are provided within the space between the inner diameter 220 and the outer diameter 230 of the drilling jar 101, thereby allowing drilling fluid (not shown) to freely flow through the inner diameter 220 of the drilling jar 101.

Figure 3:
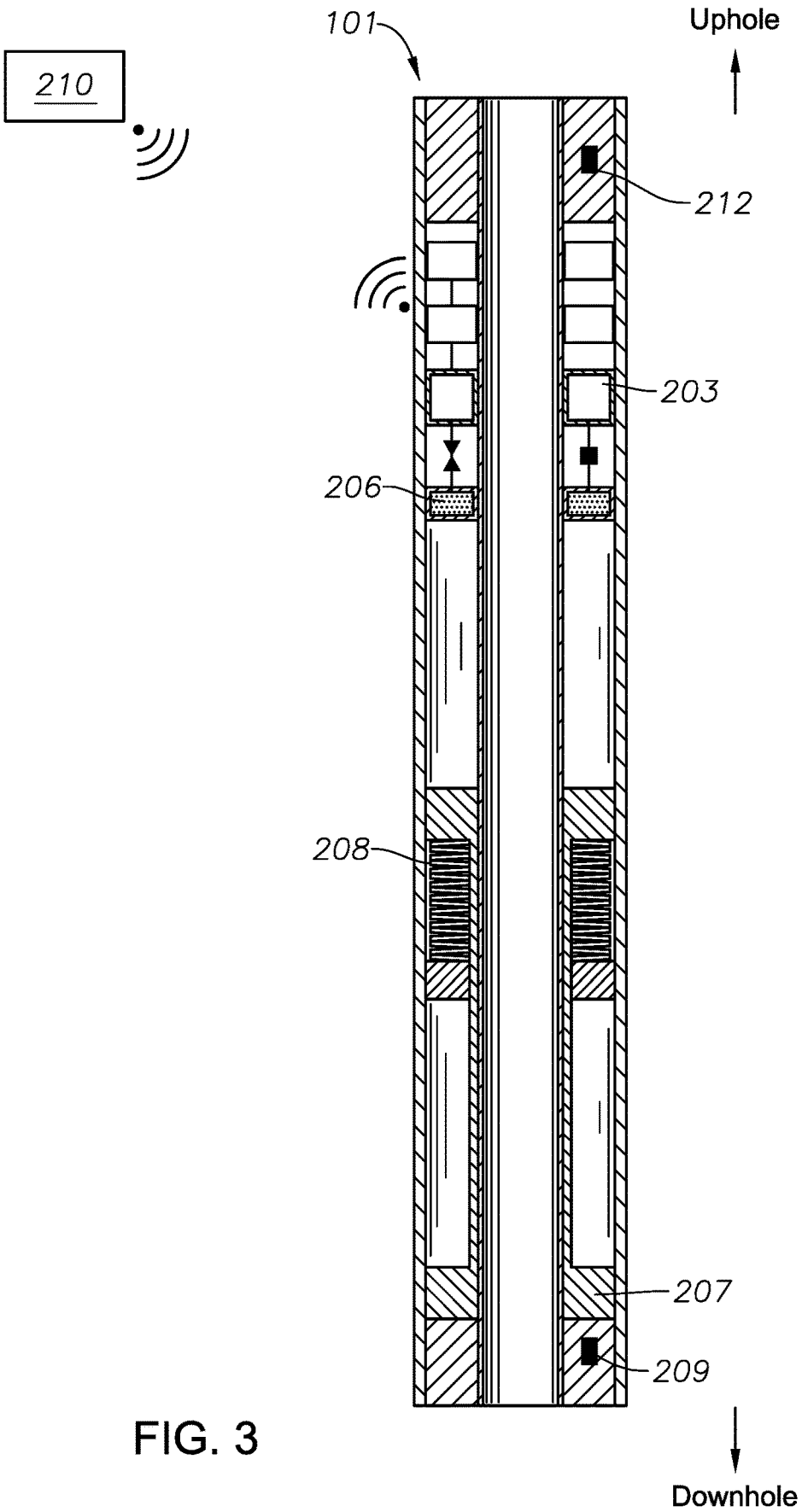
FIG. 3 is a schematic of a drilling jar in an activated state, according to one or more example embodiments.

FIG. 3 is a schematic of a drilling jar 101 in an activated state, according to one or more example embodiments. FIG. 3 shows the hydraulic oil drained from the reservoir 203 to the expandable chamber 206. The chamber 206 transmits the force to the hammer 207 which compresses the compression springs 208. As a result, the hammer 207 acts as a fast release and hits the bottom and/or top of the jar to create a shock wave a help to free the BHA. The impact force may be measured by the impact and/or impulse force sensor 209, 212. As seen in this figure, the compression springs 208 are flat when the drilling jar 101 is activated, and the hammer 207 hits the bottom of the drilling jar 101, releasing a shock wave.

One example embodiment is a method for operating a drilling jar. The method may include receiving, by a control unit including one or more transceivers configured to communicate wirelessly with a surface control unit, an activation signal from the surface control unit, and causing to activate the drilling jar in response to the activation signal. The method may also include storing hydraulic oil in a sealed hydraulic oil reservoir, and moving, by a hydraulic pump, the hydraulic oil from the hydraulic oil reservoir to an expandable chamber when the drilling jar is activated. The method may further include generating an impact and/or impulse force, by a hammer connected to the hydraulic pump, when the drilling jar is activated. The method may also include receiving, by a compression spring attached to the hammer, an impact force from the hammer, and transmitting the impact and/or impulse force to the bottom and/or top of the drilling jar. The method may further include providing a battery unit to deliver power to the hydraulic pump and the control unit. The method may also include moving, by a relief pump, the hydraulic oil from the expandable chamber to the hydraulic oil reservoir when the drilling jar is deactivated. The method may further include measuring, by an impact and/or impulse force sensor located at the bottom and/or top of the drilling jar, the impact force delivered by the hammer, and transmitting the measured value to the control unit. The method may also include storing the measured value in a non-transitory computer readable medium in the control unit, and wirelessly transmitting, by the control unit, the measured value to the surface control unit. The wireless transceivers may communicate over a wireless communication method selected from the group consisting of Wi-Fi, Wi-Fi Direct, Bluetooth, Bluetooth Low Energy, and ZigBee.

All communication between the control unit 202, hydraulic power unit 200, and impact and/or impulse sensor 209, 212 may be connected via a wire and/or wirelessly. This drilling jar 101 differs from conventional drilling jars in the market by being fully automated and remotely controlled. There is no system like this that may deliver a full diagnostic of the drilling jar, as well as, the shock wave created by the impact of the hammer in the bottom and/or top of the jar. Some advantages of the present system include multiple activation, no limitations (e.g. tension, neutral, or compression), the ability to use multiple drilling jars in the string, with no limitation for the drilling parameters, independent activation, the ability to measure the impact and/or impulse force delivered by the drilling jar, and minimum bottom hole string weight needed. The present system improves the safety on the rig floor since there is no need of high tension or compression application when stuck pipe incidents occur. The system may be used even if the stuck point is above the drilling jar. There is no limitation regarding latch system present in the hydro-mechanical drilling jar, and there is no limitation regarding weight available below or above the jar.

The drilling jar does not activate due to yo-yo effect while running the drill string to fast and stopping at a high speed causing dynamic loads and firing of the drilling jar while the drill string is suspended on the slips, which eventually may cause the BHA to jump out of the slips and drop to bottom. Besides the above problems that the present system can solve, the present system can eliminate doubts about proper activation and result of the impact of the drilling jar, and help drilling engineers to understand effectiveness while using the tool in a stuck pipe or fishing operation. The system can also help avoid costs due to a late response.

The smart drilling jar may be added to the drilling string or BHA. It may be placed anywhere in the BHA and the system may be activated independently allowing to improve the efficiency and effectiveness of the jar operation, as well as, reducing the time to do so. Multiple drilling jars may be placed in different positions and may allow to maximize the efficiency of the operation. Additionally, it may deliver full status of the system in real time. In addition, due to the well-located sensor in the bottom and/or top of the tool (impact and/or impulse force sensor), it may help to identify the effectiveness of the impact delivered by the hammer.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. A drilling jar comprising:

an inner pipe and an outer pipe, wherein the outer pipe is co-axial with the inner pipe and has a diameter greater than a diameter of the inner pipe;

a control unit provided between the inner pipe and the outer pipe, thereby allowing drilling fluid to freely pass through the inner pipe, the control unit comprising one or more transceivers configured to communicate wirelessly with a surface control unit, wherein the control unit is configured to:

receive an activation signal from the surface control unit; and cause to activate the drilling jar in response to the activation signal;

a hydraulic power unit comprising:

a sealed hydraulic oil reservoir configured to store hydraulic oil;

an expandable chamber configured to receive the hydraulic oil from the hydraulic oil reservoir;

a hydraulic pump configured to move the hydraulic oil from the hydraulic oil reservoir to the expandable chamber when the drilling jar is activated; and a relief pump configured to move the hydraulic oil from the expandable chamber to the hydraulic oil reservoir when the drilling jar is deactivated.

2. The drilling jar of claim 1, wherein the control unit further comprises:

one or more processors; and a non-transitory computer readable medium connected to the one or more processors.

3. The drilling jar of claim 1, further comprising:

a hammer connected to the hydraulic power unit, the hammer configured to generate an impact force when the drilling jar is activated.

4. The drilling jar of claim 3, further comprising:

a compression spring attached to the hammer, the compression spring configured to receive an impact force from the hammer, and transmit the impact force to the bottom of the drilling jar.

5. The drilling jar of claim 3, further comprising:

an impact force sensor located at the bottom of the drilling jar; and an impulse force sensor located at the top of the drilling jar, the impact and impulse force sensors configured to measure the impact or impulse force delivered by the hammer, and transmit the measured value to the control unit.

6. The drilling jar of claim 1, further comprising:

a battery unit configured to deliver power to the hydraulic power unit and the control unit.

7. A method for operating a drilling jar, the method comprising:

providing a control unit between an inner pipe and an outer pipe of the drilling jar, wherein the outer pipe is co-axial with the inner pipe and has a diameter greater than a diameter of the inner pipe, thereby allowing drilling fluid to freely pass through the inner pipe;

receiving, by the control unit comprising one or more transceivers configured to communicate wirelessly with a surface control unit, an activation signal from the surface control unit;

causing to activate the drilling jar in response to the activation signal;

storing hydraulic oil in a sealed hydraulic oil reservoir;

moving, by a hydraulic pump, the hydraulic oil from the hydraulic oil reservoir to an expandable chamber when the drilling jar is activated; and moving, by a relief pump, the hydraulic oil from the expandable chamber to the hydraulic oil reservoir when the drilling jar is deactivated.

8. The method of claim 7, further comprising:

generating an impact force, by a hammer connected to the hydraulic pump, when the drilling jar is activated.

9. The method of claim 8, further comprising:

receiving, by a compression spring attached to the hammer, an impact force from the hammer; and transmitting the impact force to the bottom of the drilling jar.

10. The method of claim 9, further comprising:

measuring, by an impact force sensor located at the bottom of the drilling jar or an impulse force sensor located at the top of the drilling jar, the impact or impulse force delivered by the hammer; and transmitting the measured value to the control unit.

11. The method of claim 10, further comprising:

storing the measured value in a non-transitory computer readable medium in the control unit.

12. The method of claim 11, further comprising:

wirelessly transmitting, by the control unit, the measured value to the surface control unit.

13. The method of claim 7, further comprising:

providing a battery unit to deliver power to the hydraulic pump and the control unit.

14. A drilling jar comprising:

a hydraulic power unit comprising:

a sealed hydraulic oil reservoir configured to store hydraulic oil;

an expandable chamber configured to receive the hydraulic oil from the hydraulic oil reservoir; and a hydraulic pump configured to move the hydraulic oil from the hydraulic oil reservoir to the expandable chamber when the drilling jar is activated;

a hammer connected to the hydraulic power unit, the hammer configured to generate an impact force when the drilling jar is activated;

a compression spring attached to the hammer, the compression spring configured to receive an impact force from the hammer, and transmit the impact force to the bottom of the drilling jar; and a control unit comprising one or more transceivers configured to communicate wirelessly with a surface control unit, wherein the control unit is configured to:

receive an activation signal from the surface control unit; and cause to activate the drilling jar in response to the activation signal, wherein the drilling jar has an inner pipe and an outer pipe, wherein the outer pipe is co-axial with the inner pipe and has a diameter greater than a diameter of the inner pipe;

wherein the hydraulic power unit, the hammer, the compression spring, and the control unit are provided between the inner pipe and the outer pipe of the drilling jar, thereby allowing drilling fluid to freely pass through the inner pipe of the drilling jar; and a battery unit configured to deliver power to the hydraulic power unit and the control unit.

15. The drilling jar of claim 14, further comprising:

an impact force sensor located at the bottom of the drilling jar; and an impulse force sensor located at the top of the drilling jar, the impact and impulse force sensors configured to measure the impact or impulse force delivered by the hammer, and transmit the measured value to the control unit.

* * * * *